US005641041A

United States Patent [19]

Masuda et al.

[11] Patent Number: 5,641,041

[45] Date of Patent: Jun. 24, 1997

[54] CARRIAGE LIFTING APPARATUS

[75] Inventors: Junichi Masuda, Kouna; Yoshihiro Hata, Uji, both of Japan

[73] Assignee: Murata Kikai Kabushiki Kaisha, Kyoto, Japan

[21] Appl. No.: 509,932

[22] Filed: Aug. 1, 1995

[30] Foreign Application Priority Data

Aug. 1, 1994 [JP] Japan ..... 6-200167

[51] Int. Cl.[6] ..... B66B 5/00

[52] U.S. Cl. ..... 187/347; 187/411

[58] Field of Search ..... 187/411, 406, 187/404, 401, 347, 346, 345

[56] References Cited

U.S. PATENT DOCUMENTS 2,174,043 9/1939 Scheibner ..... 187/346

FOREIGN PATENT DOCUMENTS 5201652 8/1993 Japan ..... 187/346

*Primary Examiner*—Kenneth Noland

*Attorney, Agent, or Firm*—Armstrong Westerman Hattori McLeland & Naughton

[57] ABSTRACT

A vibration-damping device is interposed between a carriage and a lifting rope. The vibration-damping device comprises a spring extended in a compressed state between a spring shoe on the lifting rope side and a spring shoe on the carriage side located above the first-mentioned spring shoe, and a damper extended between the spring shoe on the lifting rope side and the spring shoe on the carriage side, and upper and lower ends of the damper are pivotally mounted on the spring shoe on the lifting rope side and the spring shoe on the carriage side.

3 Claims, 7 Drawing Sheets

AMPLITUDES OF LIFT FOR VARIOUS VALUES OF $\xi_1$

VIBRATION SIMULATION OF LIFT (SOLID LINE: WITH OPTIMAL VIBRATION-ABSORBING APPARATUS
BROKEN LINE: WITHOUT VIBRATION-ABSORBING APPARATUS)

VIBRATION SIMULATION OF LIFT FOR VARIOUS VALUES OF $\alpha$

VIBRATION SIMULATION OF LIFT FOR VARIOUS VALUES OF $\xi_1$

CARRIAGE LIFTING APPARATUS

BACKGROUND OF THE INVENTION

1. Field of the Invention

The present invention relates to a carriage lifting apparatus.

2. Prior Art

As a conventional automated warehouse, there has been known an arrangement as follows: That is, the known arrangement includes a pair of front and rear rack devices provided in a predetermined spaced relation in a longitudinal direction and having a number of article storage shelves in every direction, and a stacker crane provided laterally movably between said front and rear rack devices, said stacker crane having a running truck, a carriage provided movably up and down along a mast provided on said running truck, and an article transfer device (for example, a slide fork provided slidably in a longitudinal direction) provided on said carriage, a driving device for said carriage comprising a winding drum rotatably provided with a diametrically central part thereof directed in a longitudinal direction with respect to the running truck or the mast of the stacker crane, a lifting rope which is secured to one end of the carriage, extended over a wheel at the upper part of the mast and thereafter the other end thereof being secured to said winding drum (in this specification, the term "rope" refers to a flexible lengthy material such as a chain, a wire rope, a belt, etc.), and a reversible motor for rotating said winding drum.

The conventional driving device for the carriage had the following disadvantages. That is, since the lifting rope on the carriage side is merely connected to the carriage, we have to merely wait till the vertical vibrations generated when the carriage is stopped due to the inertia of the carriage or the like are damped. However, this poses a great obstacle for the recent highspeed operation and for shortening the operation time.

SUMMARY OF THE INVENTION

It is an object of the present invention to provide a carriage lifting apparatus in which vertical vibrations generated when the carriage is stopped is quickly attenuated.

For overcoming the aforementioned disadvantages, the present invention employed the following means.

According to the present invention, a vibration-damping device is interposed between a carriage and a lifting rope.

The vibration-damping device comprises a spring extended in a compressed state between a spring shoe on the lifting rope side and a spring shoe on the carriage side located above the first-mentioned spring shoe, and a damper extended between the spring shoe on the lifting rope side and the spring shoe on the carriage side, and upper and lower ends of the damper are pivotally mounted on the spring shoe on the lifting rope side and the spring shoe on the carriage side.

The present invention has the following function.

It is possible to quickly attenuate the vertical vibrations of the carriage generated when the carriage is stopped.

DETAILED DESCRIPTION OF PREFERRED EMBODIMENT

Figure 1:
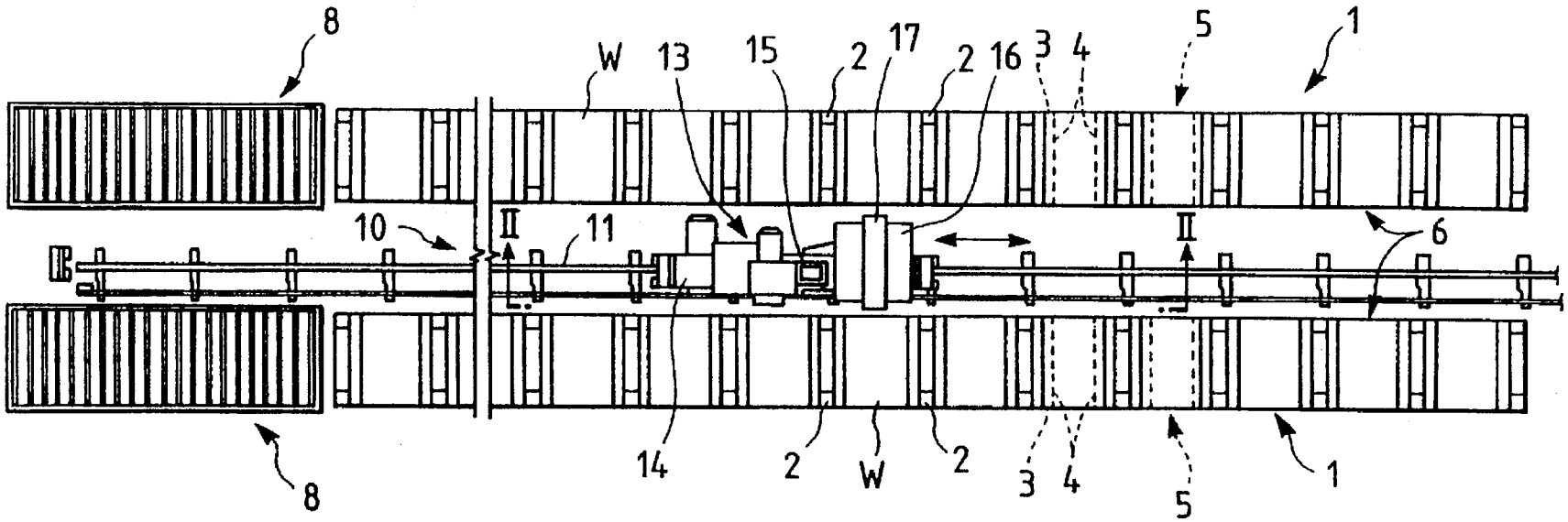
FIG. 1 is a simple plan view with an intermediate part omitted showing an embodiment of the present invention.
Figure 2:
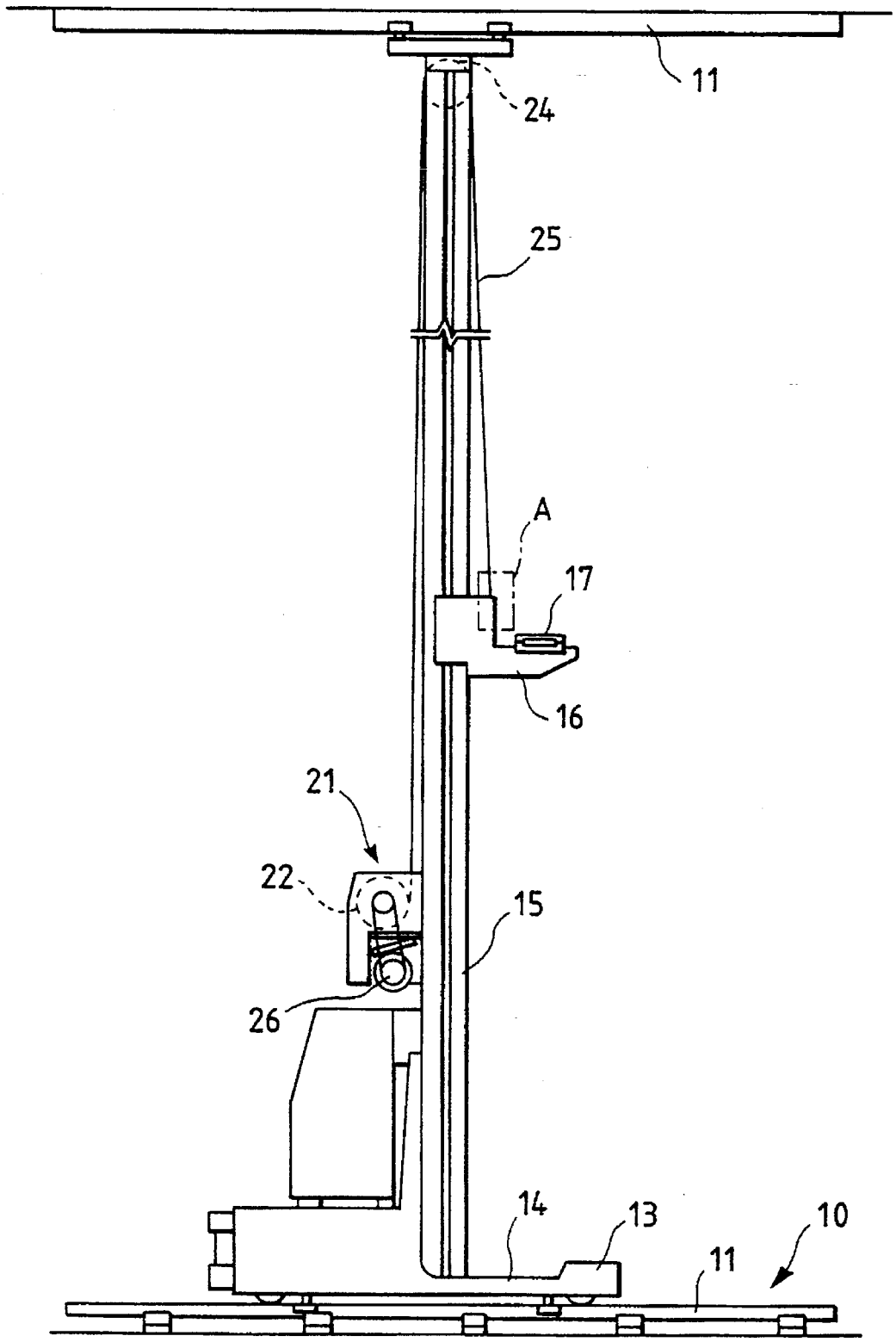
FIG. 2 is an enlarged sectional view with an intermediate part omitted taken along line II—II of FIG. 1.
Figure 3:
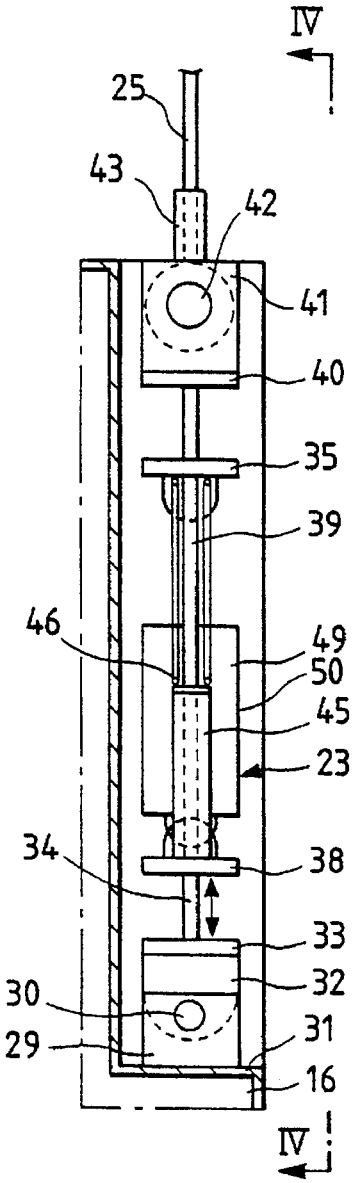
FIG. 3 is an enlarged sectional view partly cutaway of A portion of FIG. 2.
Figure 4:
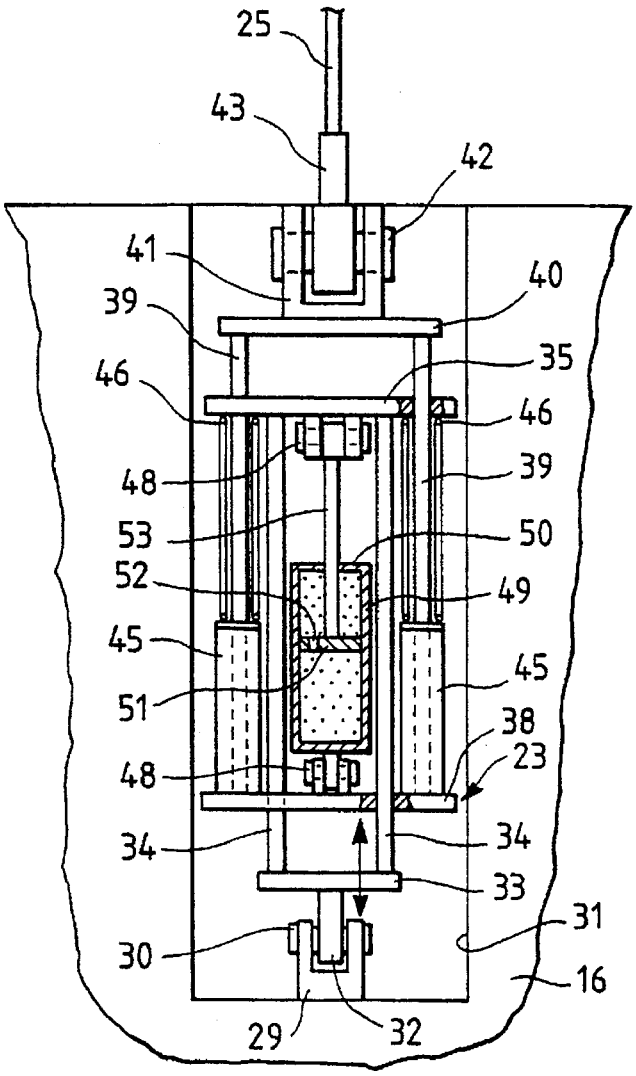
FIG. 4 is a sectional view taken on line IV—IV of FIG. 3.

The present invention will be described by way of an embodiment with reference to the drawings. In the specification, "front" designates a lower side in FIG. 1, "rear" designates an upper side in FIG. 1, "left" designates a left side in FIG. 1, and "right" designates a right side in FIG. 1.

A pair of front and rear rack devices 1 are stood upright on the floor surface so as to provide a space for a stacker crane passage 10.

The rack devices 1 have a number of stanchions 2 on the front side arranged to left and right in a predetermined spaced relation, stanchions 2 arranged at the rear of and in a predetermined spaced relation with the stachions 2 on the front side, and a number of article supporting members 4 provided in a predetermined spaced relation heightwise of said front and rear stanchions 2, the pair of left and right opposed supporting members 4 constituting article storage shelves 3 without interposing the stanchions 2. A fork passage gap 5 for allowing a slide fork 17 (which will be described later) to move up and down is constituted between the pair of left and right article supporting members 4.

Inlet-and-outlets 6 for the article storage shelves 3 of the front and rear rack devices 1 are opposed to each other.

Inlet/outlet roller conveyors 8 with a carrying direction directed in a lateral direction are provided on the left side of the rack devices 1.

A well known article lift (not shown) is provided on the side of the inlet/outlet roller conveyor 8. The article lift has a carriage that can be moved up and down by a well known lift below the roller of the inlet/outlet conveyor 8, and a pair of supporting frames stood upright on the carriage and located between the rollers of the inlet/outlet conveyors 8. The article lift functions to form a fork inserting gap between a carrying surface of the inlet/outlet conveyor 8 and a lower surface of an article W by raising the article W by the supporting frame, to receive the article W from the slide fork 17 by the supporting frame moved upward, and thereafter to move down the article W to the inlet/outlet roller conveyor 8.

A pair of upper and lower guide rails 11 are disposed with lengthwise thereof directed in a lateral direction on the stacker crane passage 10 so that a stacker crane 13 is guided to be moved to left and right along the guide rails 11, the stacker crane 13 having a running truck 14, a carriage 16 which is vertically movable with respect to a mast 15 provided on the running truck 14, and a slide fork 17 which is horizontally slidably moved in a longitudinal direction by a well known forward and backward mechanism on the carriage 16. The slide fork 17 can, as is known, take the article W into the carriage 16 through the operation of projection of the article W downward, raising of the article W by upward movement of the carriage 16 and withdrawal thereof toward the carriage 16, and can lower the article W toward the article storage shelves 3 through the operation reversed to the former.

The driving device 21 for the carriage 16 is constructed as follows: The driving device 21 comprises a winding drum 22 rotatably provided with a diametrically central part thereof directed in a longitudinal direction with respect to the mast 15 of the stacker crane 13, a lifting rope 25 which is secured to one end of the carriage 16 through a vibration-damping device 23, extended over a wheel 24 at the upper part of the mast 15 and thereafter the other end thereof being secured to said winding drum 22, and a reversible motor 26 for rotating said winding drum 22.

With the construction as described above, by rotating the winding drum 22, it is possible to wind or rewind the lifting rope 25 to move the carriage 16 up and down.

The vibration-damping device 23 is constructed as follows: A bracket 29 is provided on the bottom of a notch 31 formed in a vertical portion of the carriage 16, a vertical piece 32 is pivotally mounted on the bracket 29 by a pin 30 with a diametrically central part thereof directed in a longitudinal direction, a horizontal piece 33 is secured to the vertical piece 32, two rods 34 are stood upright on the horizontal piece 33, a spring shoe 35 (a spring shoe 35 on the side of the carriage 16) is extended over the upper end of these rods 34, a spring shoe 38 (a spring shoe 38 on the side of the lifting rope 25) is provided vertically movably on the spring shoe 35, two rods 39 are stood upright on the spring shoe 38, said rods 39 extending through the spring shoe 35 and protruding above the spring shoe 35, a connecting piece 40 is extended over the upper end of these rods 39, and a connecting rod 43 at the end of the lifting rope 25 is pivotally mounted on a bracket 41 of the connecting piece 40 through a pin 42 with a diametrically central part thereof directed in a longitudinal direction.

A sleeve 45 is fitted over a lower portion of the rod 39, and a spring 46 extended in a compressed state is fitted over an upper portion of the rod 39. That is, the lower end of the spring 46 comes in contact with the sleeve 45, and the upper end of the spring 46 comes in contact with the spring shoe 35.

A damper 49 is extended over the spring shoe 38 and the spring shoe 35 through an axis 48 with a diametrically central part thereof directed in a longitudinal direction. The damper 49 has a closed casing 50 filled with liquid and a piston 51 having a communication hole 52. That is, the closed casing 50 is pivotally mounted on the spring shoe 38 by the axis 48, and a rod 53 of the piston 51 is pivotally mounted on the spring shoe 35 through the axis 48.

With the above-described construction, a spring constant of the spring 46 and an attenuation force of the damper 49 are adjusted in consideration of the inertia of the carriage 16 whereby the vertical vibrations of the carriage 26 generated when the carriage 16 is stopped can be attenuated in a short period of time about ⅕ of prior art.

Figure 5:
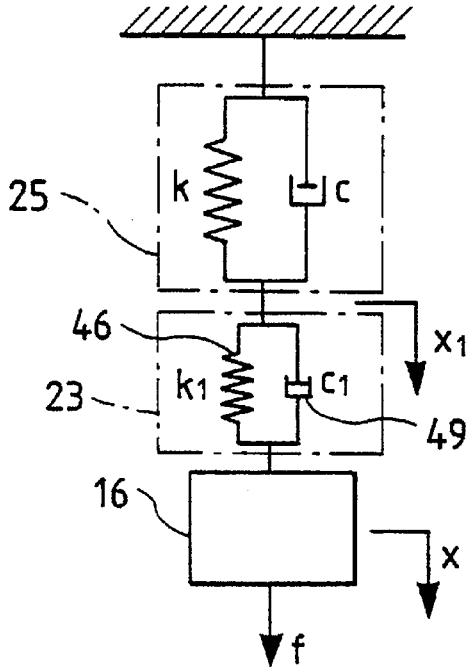
FIG. 5 is a view showing a model for analysis of a vibration-damping device.

In the following, a model for analysis as shown in FIG. 5 is set to obtain optimal values of a spring constant ratio ($\alpha$) and damping rate ($\xi_1$) of the damper 49 of the vibration-damping device 23, which will be described later.

(MOTION EQUATION AND TRANSMISSION FUNCTION)

In FIG. 5 and equation (1), symbols are represented as follows:

m: Mass of platform 16 k: Spring constant of lifting rope 25

$k_1$: Spring constant of spring 46 of vibration-damping device 23 c: Equivalent viscous damping coefficient of lifting rope 25

$c_1$: Viscous damping coefficient of damper 49 of vibration-damping device 23 x: Vertical displacement of carriage 16

$x_1$: Vertical displacement of end of lifting rope 25 f: Exciting force applied to carrage 16

The fundamental motion equation of the carriage 16 is written below:

$$\begin{cases} m\ddot{x} = -k_1(x - x_1) - c_1(\dot{x} - \dot{x}_1) + f \\ k x_1 + c\dot{x}_1 = k_1(x - x_1) + c_1(\dot{x} - \dot{x}_1) \end{cases} \quad (1)$$

When all the initial conditions are set to 0 and Laplace transform takes place, displacement and transmission function of exciting force can be obtained.

For simplification, the following symbols are introduced.

| | |
|---|---|
| $\omega_n = \sqrt{k/m}$ ; | Natural frequency of carriage 16 |
| $\alpha = k_1/k$; | Spring constant ratio |
| $\xi = c/2\sqrt{mk}$ ; | Equivalent damping rate of lifting rope 25 |
| $\xi_1 = c_1/2\sqrt{mk}$ ; | Damping rate of damper 49 of vib.-damper 23 |
| $\lambda = s/\omega_n$; | Complex number |

If these symbols are used, the transmission function can be represented by a dimensionless parameter as follows:

$$G(\lambda) = \frac{X(\lambda)}{F(\lambda)} = \frac{1}{k}\,\frac{(1+\alpha) + 2(\xi + \xi_1)\lambda}{\lambda^2[(1+\alpha) + 2(\xi + \xi_1)\lambda] + \ldots \ldots (1 + 2\xi\lambda)(\alpha + 2\xi_1\lambda)} \quad (2)$$

(OPTIMUM DESIGN BY FREQUENCY RESPONSE)

Substituting $\lambda = ig$ in Equation (2) gives a dimensionless frequency response.

$$\frac{X}{X_{st}} = \frac{(1+\alpha) + i2(\xi + \xi_1)g}{[\alpha - 4\xi\xi_1 g^2 - (1+\alpha)g^2] + \ldots \ldots i2[(\alpha - g^2)\xi + (1 - g^2)\xi_1]g} \quad (3)$$

Here, $g = \omega/\omega_{ni}$ Exciting vibration number ratio $X_{st} = F_0/k$; Static deflection of carriage 16

$\omega$; Exciting vibration number ratio $F_0$; Amplitude of exciting force

If the damping of the lifting rope 25 is so small that it can be disregarded, $\xi = 0$ results. At this time, Equation (3) is as follows:

$$\frac{X}{X_{st}} = \frac{(1+\alpha) + i2\xi_1 g}{[\alpha - (1+\alpha)g^2] + i2\xi_1(1 - g^2)g} \quad (4)$$

The absolute value of amplitude takes the following form.

$$\left|\frac{X}{X_{st}}\right| = \sqrt{\frac{A^2 + B^2(2\xi_1)^2}{C^2 + D^2(2\xi_1)^2}} \quad (5)$$

$(AD)^2 = (BC)^2$, that is, $$[(1+\alpha)(1-g^2)g]^2=\{[\alpha-(1+\alpha)g^2]g\}^2 \quad (6)$$

Then, $|X/X_{st}|$ has nothing to do with the damping rate $\xi_1$ of the damper 49. Equation (6) can be solved by $$g_1=0, \quad g_2=\sqrt{\frac{1+2\alpha}{2(1+\alpha)}} \quad (7)$$

Figure 6:
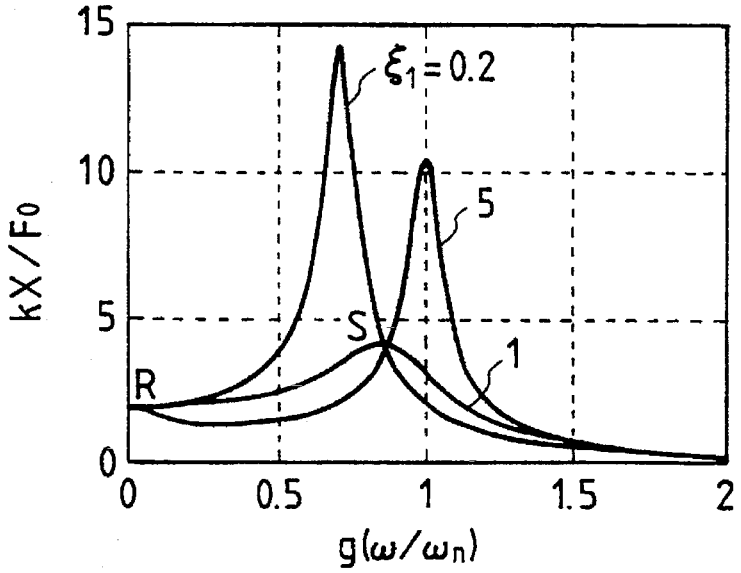
FIG. 6 is a graph of amplitude of a carriage.

That is, even if $\xi_1$ is changed, a frequency response curve passes fixed points at $g_1$ and $g_2$, as shown in FIG. 6. It is understood from FIG. 6 that fixed points R and S are present.

For minimizing a resonant peak of a frequency response similar to an optimum design theory of a dynamic vibration reducer, it is necessary (1) to make sizes of longitudinal coordinates of points R and S equal and (2) to allow a peak of the response curve to cross the point S. The optimum value of $\alpha$ is determined by the condition (1), and the optimum value of $\xi_1$ is determined by the condition (2).

These optimum values can be obtained as follows:

$$\alpha_{opt}=\frac{1}{2}, \ \xi_{1_{opt}}=\frac{3}{8}\sqrt{6}\approx 0.92 \quad (8)$$

At this time, the peak value of the response curve or the longitudinal coordinates of the fixed points R and S are as follows:

$$\left|\frac{X}{X_{st}}\right|=3 \quad (9)$$

(CALCULATION OF NUMERICAL VALUES)

The frequency response of the carriage 16 is calculated by Equation (4) or (5). The transient response can be generally calculated by a numerical calculation method such as a Runge-Kutta method. However, here, consideration is made of only the impulse response, and the impulse response is obtained using a reverse Fourier transform of the frequency response. In the calculation, the damping rate of the lifting rope 25 is considered to be $\xi_1$=0.05 from the actually measured value.

(VIBRATION-DAMPING EFFECT OF OPTIMALLY DESIGNED VIBRATION-DAMPING DEVICE 23)

Figure 7A:
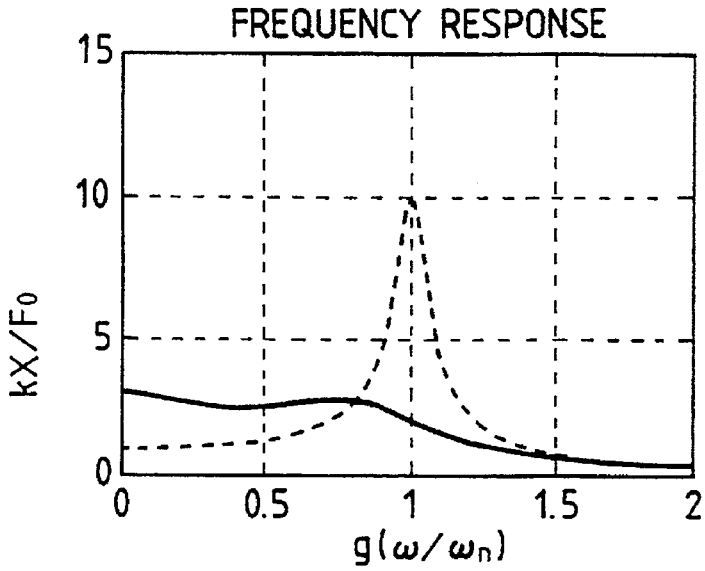
FIGS. 7*a* and 7*b* are first vibration simulation graphs of the carriage.
Figure 7B:
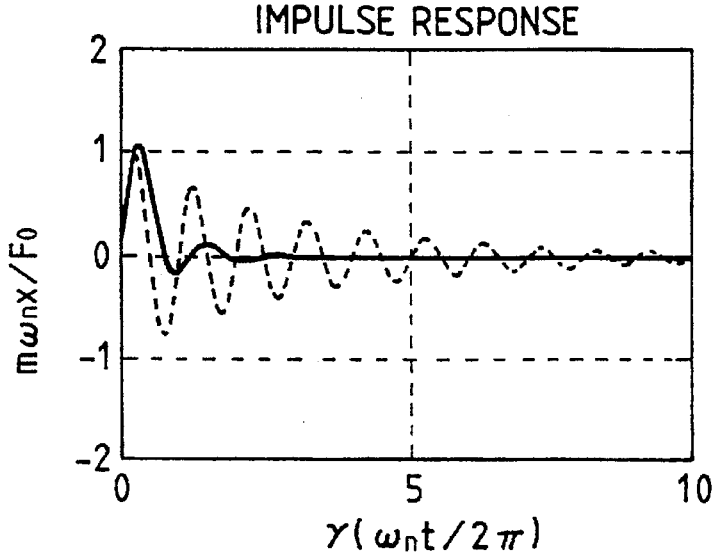

FIGS. 7*a* and 7*b* show a comparison of vibration responses of the carriage 16 between the case where the vibration-damping device 23 using the optimum value is mounted and the case where it is not mounted, namely, the carriage 16 is directly mounted on the lifting rope 25. In FIGS. 7*a* and 7*b*, the solid line indicates the case where the vibration-damping device 23 is mounted, and the broken line indicates the case where the vibration-damping device 23 is not mounted. As will be understood from FIG. 7*a*, in the case where the vibration-damping device 23 is mounted, the frequency response curve has no resonant pea and is a flat curve, and the transient response is damped to 0 out of about 2 periods as is shown in FIG. 7*b*. However, a static deflection is three times of the case where the vibration-damping device 23 is not mounted.

(INFLUENCE CAUSED BY CHANGE OF PARAMETER OF CARRIAGE 16)

In the actual carriage 16, the spring constant k of the lifting rope 25 is different due to a certain height of the carriage 16 and the mass m of the carriage 16 is also changed due to the loadage. As these change, the spring constant $\alpha$ and the attenuation rate $\xi_1$ of the damper 49 change. Accordingly, it is necessary to examine how the vibration response of the carriage 16 changes when these parameters are changed.

Figure 8A:
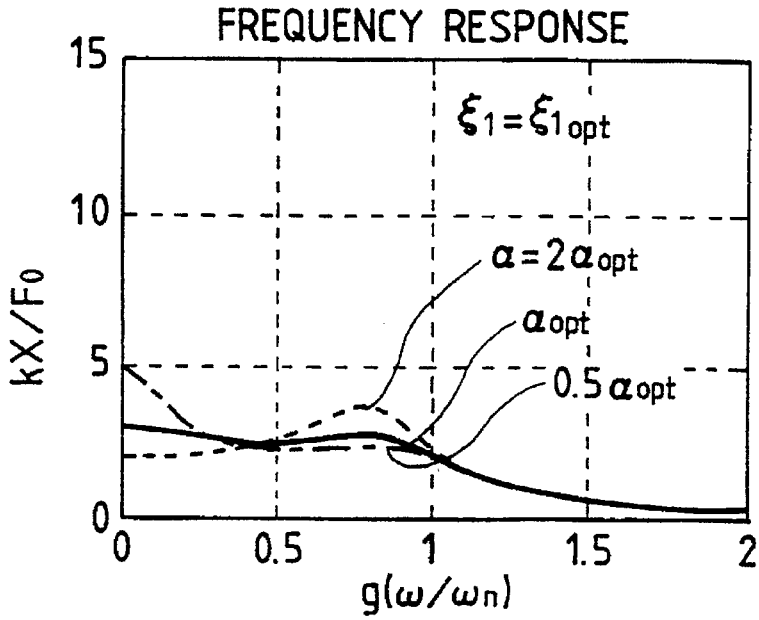
FIGS. 8*a* and 8*b* are second vibration simulation graphs of the carriage and FIGS. 9*a* and 9*b* are third vibration simulation graphs of the carriage.
Figure 8B:
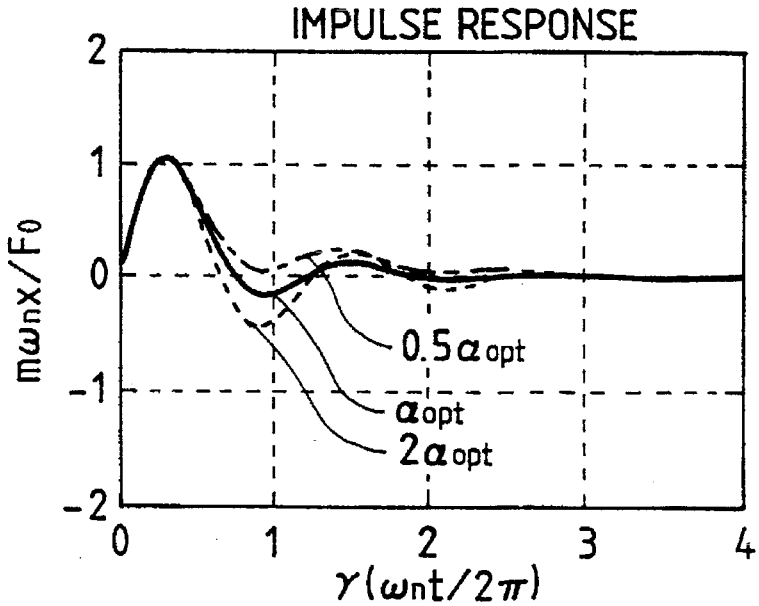
Figure 9A:
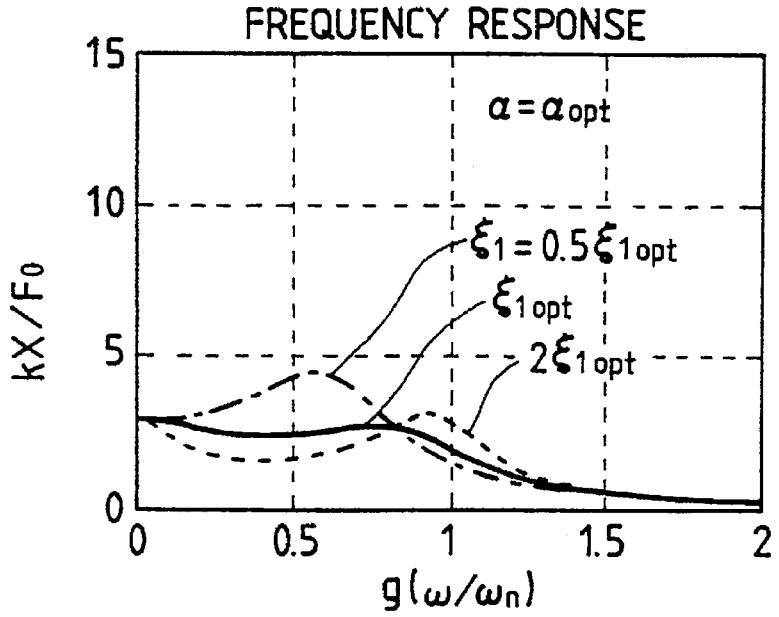
Figure 9B:
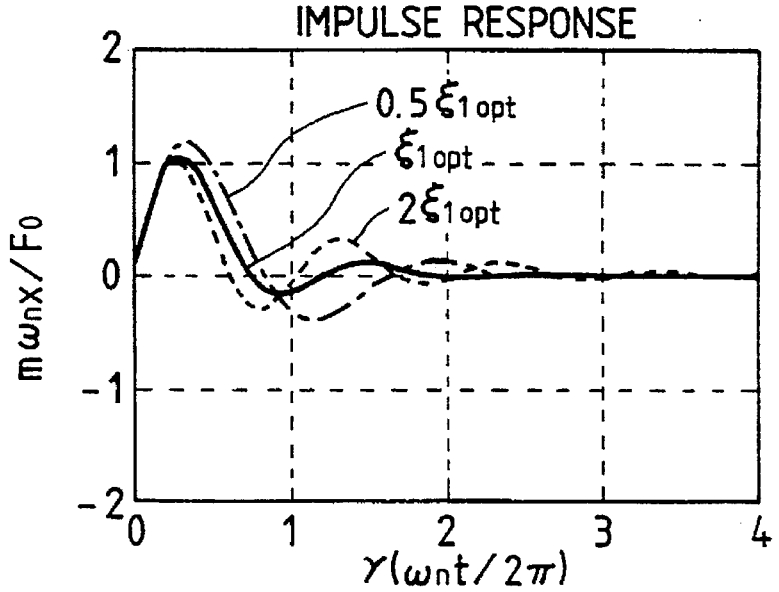

The vibration response of the carriage 16 when the spring constant $\alpha$ and the damping rate $\xi_1$ change is shown in FIGS. 8 and 9. According to these figures, it is understood that if the optimum value is a reference value, even if the spring constant $\alpha$ and the damping rate $\xi_1$ are changed between 0.5 and 2 times of the reference value, the vibration response is sufficiently suppressed.

(MODIFICATIONS)

Modifications or the like will be explained below.

(1) Needless to say, the damper 49 is not limited to that shown in the embodiment but a well known damper and shock absorber having a damping function making use of a viscosity of other fluids can be used.

(2) Further, needless to say, the apparatus according to the present invention can be also used as a lifting device for a carriage in a stereo-parking lot and a lifting device for a lift cage of an elevator.

By the provision of the aforementioned construction, the present invention exhibits the following effects.

1 According to the present invention, it is possible to quickly damp the vertical vibrations generated when the carriage is stopped.

2 Further, according to the present invention, it is possible to adjust the spring constant of the spring and the damping force of the damper in consideration of the inertia of the platform and the like to thereby more quickly damp the vertical vibrations of the carriage.

3 Still further, according to the present invention, since the upper and lower ends of the damper are pivotally mounted on the spring shoe on the lifting rope side and on the spring shoe on the carriage side so that the damper is horizontally movable With respect to the spring shoes, it is possible to prevent a horizontal unreasonable force from acting on the damper.

What is claimed is:

1. A carriage lifting apparatus, comprising:

a carriage having an inertia when lifted;

a lifting rope; and means for dampening vibrations interposed between said carriage and said lifting rope, said means for dampening comprising a first spring shoe having a spring constant mounted on a lifting rope side of said carriage lifting apparatus;

a second spring shoe having a spring constant mounted on a carriage side of said carriage lifting apparatus, said second spring shoe disposed above said first spring shoe;

a spring having a compressed condition and a non-compressed condition such that said spring in said compressed condition is interposed between said first and second spring shoes; and a damper, having a dampening force and upper and lower ends, mounted between said first and second spring shoes.

2. The carriage lifting apparatus as recited in claim 1, wherein each of said upper and lower ends of said damper is pivotally connected to said second and first spring shoe, respectively.

3. The carriage lifting apparatus as recited in claim 2, wherein said spring constant of each of said first and second spring shoes , and said dampening force of said damper are adjusted in consideration of said inertia of said carriage.

* * * * *